US009038641B2

(12) United States Patent
Moser et al.

(10) Patent No.: US 9,038,641 B2
(45) Date of Patent: May 26, 2015

(54) DEVICE FOR FILLING A CIGARETTE TUBE WITH A METERED AMOUNT OF TOBACCO

(71) Applicants: Larry E. Moser, Moser, IN (US); Robert J. Daily, New Albany, IN (US); Mark Baldwin, Fairfield, CA (US)

(72) Inventors: Larry E. Moser, Moser, IN (US); Robert J. Daily, New Albany, IN (US); Mark Baldwin, Fairfield, CA (US)

( * ) Notice: Subject to any disclaimer, the term of this patent is extended or adjusted under 35 U.S.C. 154(b) by 302 days.

(21) Appl. No.: 13/815,079

(22) Filed: Jan. 30, 2013

(65) Prior Publication Data

US 2014/0209103 A1 Jul. 31, 2014

(51) Int. Cl.
*A24C 5/06* (2006.01)
*A24C 5/42* (2006.01)

(52) U.S. Cl.
CPC .... *A24C 5/06* (2013.01); *A24C 5/42* (2013.01)

(58) Field of Classification Search
CPC ..... A24C 5/02; A24C 5/06; A24C 5/42; A24C 5/1807; A24C 1/08
USPC ..... 131/38, 45, 66.1–66.2, 70, 74, 77, 78, 131/81.1, 108; 100/215
See application file for complete search history.

(56) References Cited

U.S. PATENT DOCUMENTS

| | | | | | |
|---|---|---|---|---|---|
| 2,551,095 | A * | 5/1951 | Chaze | 222/162 |
| 2,775,969 | A * | 1/1957 | Wheeler | 131/364 |
| 4,215,705 | A * | 8/1980 | Marcil | 131/70 |
| 4,230,132 | A * | 10/1980 | Crisp | 131/70 |
| 4,534,367 | A * | 8/1985 | Newsome | 131/75 |
| 4,572,216 | A * | 2/1986 | Josuttis et al. | 131/70 |
| 5,009,237 | A * | 4/1991 | Schmidt et al. | 131/70 |
| 5,666,975 | A * | 9/1997 | Lord | 131/70 |
| 6,206,006 | B1 * | 3/2001 | Schutze et al. | 131/70 |
| 6,431,812 | B1 * | 8/2002 | Budny | 414/404 |
| 6,484,867 | B2 * | 11/2002 | Spatafora et al. | 198/418.1 |
| 6,557,560 | B2 * | 5/2003 | Kastner | 131/73 |
| 6,571,800 | B1 * | 6/2003 | Yu | 131/70 |
| 6,739,343 | B1 * | 5/2004 | Trinkies et al. | 131/58 |
| 6,913,022 | B2 * | 7/2005 | Moser et al. | 131/70 |
| 2012/0240945 | A1 * | 9/2012 | Laplante et al. | 131/77 |

* cited by examiner

*Primary Examiner* — Richard Crispino
*Assistant Examiner* — Eric Yaary
(74) *Attorney, Agent, or Firm* — William S. Bernheim

(57) ABSTRACT

A device for filling cigarette tubes that can be designed and used manually, partially automatically, or, fully automatically for packing cigarette tubes with a metered, precise amount of tobacco that leads to a consistent filling of the tube to an even and complete density such that the burning rate and continuity are consistently the same, regardless of the cut of tobacco being used, or of moisture content of the tobacco, and, independent of operator control variables.

3 Claims, 5 Drawing Sheets

DEVICE FOR FILLING A CIGARETTE TUBE WITH A METERED AMOUNT OF TOBACCO

CROSS REFERENCE TO RELATED APPLICATIONS

This application is a Continuation in Part of U.S. application Ser. No. 11/312,782, that was filed on Dec. 20, 2005, first published on May 11, 2006 and was noticed for allowance on Nov. 8, 2011, and applicant claims the benefit of that application.

BACKGROUND

1. Field of the Invention

The present invention relates generally to a device for filling cigarette tubes with tobacco, and more particularly to a fully manual, partially automated or fully automated device for filling cigarette tubes with precisely metered amounts of tobacco that is packed to a selectable, uniform and adequate density that allows for an even burn at a selectable rate of burn on a consistent basis.

2. Description of the Relevant Prior Art

Cigarette tubes generally comprise a paper cylinder having an open end and a filter end. Various manual, semi-automatic and automatic machines exist in the market for allowing a user to fill such tubes with loose tobacco to make their own cigarettes.

A major problem associated with home-made cigarettes involves the lack of uniformity of and density of the pack of tobacco within the cigarette tube. At one extreme, in the absence of a dense and uniform packing of tobacco into the tube, the burning cigarette tip can fall off the cigarette, creating a fire hazard; less extreme problems such as uneven burning and die off of the burning tip and alteration of the smoking properties such as varying pull, taste and smoking periods of differing lengths can occur; even the levels of dangerous substances in self-filled cigarettes have been shown to be related to differing degrees of filling of the cigarette tubes.

A major shortcoming of many of the prior art models is that they lack means to deal with different cuts of tobacco, such as shag cut or bulk cut and they also do not provide means for dealing with tobaccos of varied moisture contents and the changed compression characteristics thereof.

The size of the particles of tobacco within a particular cut and batch of tobacco may vary considerably.

The most common means of determining the amount of tobacco needed for optimal filling of a series of cigarette tubes involves use of an algorhythm based on a predetermined number of strokes of a tobacco delivering means to the compression chamber of the device. However, because of the variation in particle size, and/or moisture content within a batch of tobacco, such methods lead to less consistent filling of the tubes, and, alteration of the smoking properties, which alterations smokers do not appreciate.

Some smokers prefer a cigarette requiring a "light" draw for smoking, such cigarettes need a lighter density of pack; other prefer a harder draw and for them, a denser pack is indicated.

The following patented devices, some manual and some semi automatic in nature, either depend upon the user's tactile sense in compressing the tobacco to form the pre-insertion cigarette rod; or, depend upon use of a predetermined loading amount of tobacco into a compression chamber to create the finished pre-insertion tobacco rod: U.S. Pat. No. 4,534,367 (Newsome-August 1985); U.S. Pat. No. 4,215,705 (Marcil-April 1991); U.S. Pat. No. 5,009,237 (Schmidt-April 1991); U.S. Pat. No. 5,666,975 (Lord-September 1997); U.S. Pat. No. 6,206,006 (Schutze-March 2001); U.S. Pat. No. 6,431,812 (Budny-August 2002); U.S. Pat. No. 6,484,867 (Spatafora-November 2002); U.S. Pat. No. 6,557,560 (Kastner-May 2003); U.S. Pat. No. 6,571,800 (Yu-June 2003); U.S. Pat. No. 6,739,343 (Trinkies-May 2004). U.S. Pat. No. 6,978,789 (Garbarino-December 2005); U.S. Pat. No. 7,537,013 (Nelson-May 2009); U.S. Pat. No. 7,565,818 (Thomas-July 2009); U.S. Pat. No. 7,597,105 (Barnes-October 2009);

The following five U.S. Patents have been chosen as representative of the above group and are subjected to a more detailed analysis.

U.S. Pat. No. 6,571,800 (Yu) is a portable hand filling device in which manual compression into the compression section is used to create the finished pre-insertion tobacco rod. 1. The obvious problem with Yu's device is that dependence on a user's tactile sense, while that user's hand is being used to forcefully compress the tobacco into a rod shape, is most likely not going to consistently create rods of uniform density of pack either within that rod, much less as between a successive series of rods. 2. Yu does not, as is mandated by MPEP 2143.5: 1. teach all the limitations of the current invention, nor does it; 2. provide any evidence establishing a motivation to use a dual-plate injection/compression/compression -monitoring assembly ("dual-plate assembly") such as is taught in the current invention.

U.S. Pat. No. 2,551,095 (Chaze-May 1951) presents another example of a hand operated cigarette tube filling machine. The device includes a hopper (named as the "scraper" component), within which a flat bottomed "pusher" member, under activation of a pair of springs, creates a downward pressure on underlying tobacco fibers. Alternate rotation of the hopper/scraper right to left, incrementally forces tobacco to pass downward into a compression chamber ("gutter" component), wherein, manual pressure can be applied to drive a compression member forward, thus compressing the tobacco into a rod shape; manual activation of a push rod affixed longitudinally with an extraction spoon allows moving the compressed tobacco into a waiting cigarette tube.

Problems associated with Chaze' device: 1. Although Chaze Claims a metering component, Chaze', ending metering activity is based upon an algorhythm and does not include a dual-plate assembly structure such as is found in the current invention; hence Chaze does not, as is mandated by MPEP 2143.5: 1. teach all the limitations of the current invention; nor does it 2. provide any evidence establishing a motivation to use such a dual-plate assembly.

Another device, U.S. Pat. No. 4,572,216 (Josuttis-February 1986): Compression of the loose tobacco from the hopper into a rod suitable for loading into a cigarette tube is accomplished by passing the tobacco through a rotating tobacco-conveyor spring of increasingly narrower dimension, thus forming a continuous strand of compressed tobacco for injection into a waiting cigarette tube.

Problems associated with Josuttis' device include: 1. it is limited to use with fine fibered tobacco and is not suitable for use with other cuts of tobacco. 2. the tobacco conveyor spring taught is specific for tobacco tubes of specific wall thickness and diameter; if any other tube is used, the conveyer spring which is finely spaced in taper, wind spacing and pitch along its three section length must be replaced with another specially fabricated spring section. 3. Although Josuttis states that suitable tracer or sensor devices (not illustrated at all, much less illustrated in detail) can be used to register when the cigarette tube is completely filled, there is no provision of any manner of monitoring or regulating the actual state of compression of the finished tobacco rod before its removal to the cigarette tube. 4. And as opposed to the primary structural component of this invention, Josuttis teaches no moveably conjoined double-plate assembly component that is slideably reciprocating along its long axis as part of the insertion/compression operation. hence Josuttis does not, as is mandated by MPEP 2143.5: 1. teach all the limitations of the current invention; nor does it 2. provide any evidence establishing a motivation to use such a dual-plate assembly.

A more recent device, U.S. Pat. No. 6,739,343 (Trinkies-May 2004), comprises a funnel-shaped hopper having a bottom opening up through which projects a rotatable, toothed cylinder (plucking roller); the teeth grasp tobacco fibers in the hopper and move them down into a tobacco supply chamber. Compression of the tobacco into a rod is created by pushing a series of incremental tobacco loads from the supply chamber into the compression section; the supply chamber, in this device, the compression section, injection section and the empty cigarette tube are all in a longitudinal alignment along a common axis of movement with each other.

The number of rotations of the toothed cylinder needed to provide an adequate fill of the tube is determined experimentally, thus providing an algorithm that determines how much tobacco will be inserted into the compaction chamber.

Problems associated with Trinkie's device include: 1. It can only handle long-fiber filling tobacco. 2. Although adequate compression of the tobacco can be achieved based on a pre-determined number of compression strokes, there is no provision for accurately determining the actual density of each compressed tobacco rod and so inconsistencies of pack density will occur. 3. There is no provision of "fine tuning" the density of the individual cigarettes made from a tobacco of known dryness and cut to create a cigarette with a harder or lesser draw in accordance with a smoker's preferred draw characteristics. 4. As opposed to the primary structural component of this invention, Trinkies teaches a separate, tubular insertion member feeding tobacco along a central long axis of the tobacco roll to be formed, and teaches a separate, orthogonally placed compression member as part of the insertion/compression assembly and operation. 5. Trinkies does not, as is mandated by MPEP 2143.5: 1. teach all the limitations of the current invention; nor does it 2. provide any evidence establishing a motivation to use such a dual-plate assembly as is integral in the structure of the current invention.

U.S. Pat. No. 7,789,087 (Pham-September 2010) teaches a device with electrical, electronic and mechanical features, and includes automatic succession of sequential empty tubes from a hopper with a computer providing electronic control of the cigarette tube filling and packing apparatuses. j Main Problems with the device are: 1. Unlike the current invention, Pham's device does not provide for monitoring each finished pre-injection cigarette-rod for optimal compression. 2. Rather, control of packing density is through an algorithm involving use of an experimentally determined number of up and down "shakes" of the hopper to move more or less tobacco into the compression chamber. The idea being that a fewer number of shake cycles may create a more loosely filled cigarette, and programming a higher number of "shakes" will load and compact the tobacco into loading chamber to form a more densely packed cigarette. 3. Pham does not, as is mandated by MPEP 2143.5: 1. teach all the limitations of the current invention; 2. nor does it provide any evidence establishing a motivation to use such a dual-plate assembly as is taught in the current invention.

SUMMARY

As explained above, the major drawback to the prior art machines in the cigarette tube filling art is that the structural configuration of such machines lack the ability to fill a successive series of tubes with a precise quantity of tobacco that is packed to a uniform and adequate density that allows for an even burn on a consistent basis.

The Yu, Chaze, Josuttis, Trinkies and Pham devices can generally adequately compress and inject tobacco into waiting tubes, however, they (a) depend on the user of the machine to judge when the compression chamber has been packed with a sufficient amount of tobacco, or (b) must rely on an algorithm that in one way or another provides a predetermined amount of tobacco into the compression chamber for creating the finished pre-insertion tobacco rod into the waiting cigarette tube; (c) none teach, claim or even lead one knowledgeable in the art to create a structural component comprising in part a moveably conjoined, double-plate injection/compression/compression-assessment assembly; the presence of which structural assembly provides that each finished pre-injection rod will be consistently compressed to the same density and evenness of pack.

The machines thus have no means to automatically meter an "optimal" amount of tobacco for eventual injection inside of the tubes. Moreover, such devices generally lack the capability of dealing with different cuts of cigarette tobacco, such as shag cut or bulk cut, or tobaccos of various moisture contents, etc.

The result is that these machines commonly form cigarettes which are uneven or incomplete in their density, and/or which may not burn properly or fall apart when burned, which cigarette smokers generally find undesirable.

As opposed to the cited patents and others reviewed, the current invention provides a structural assembly that (a) automatically and precisely fills each of a series of tubes to an exact density of pack, regardless of variations in tobacco cut or moisture content; and (b) allows for "fine tuning" the pack density to account for differing draw characteristics as such are desired by different smokers.

Objective Evidence of the Non-Obviousness of the Current Invention

A. Issue of an Existence of "Long Felt But Unsolved Needs"Coupled With the "Failure of Others" to Provide a Full Solution to that Need A major issue that has been repeatedly stated as of great importance in patents in the prior art is the lack of consistent quality of filling of cigarette tubes, otherwise commonly expressed as the problem of a lack of uniform density of pack in the filled tubes and the problems resulting there-from such as uneven burn of the cigarettes, falling off of the burning tip, etc.

This has extended at least from U.S. Pat. No. 4,230,132 (Crisp-October 1980; on priority of GB App 49401/77 November 1977); and on through: U.S. Pat. No. 4,534,367 (Newsome-August 1985); U.S. Pat. No. 4,572,216 (Josuttis-February 1986); U.S. Pat. No. 5,009,237 (Schmidt-April 1991); U.S. Pat. No. 6,739,343 (Trinkies-May 2004); U.S. Pat. No. 6,913,022 (Moser-July 2005); U.S. Pat. No. 7,579,105 (Barnes-October 2009); U.S. Pat. No. 7,565,818 (Thomas-July 2009) and U.S. Pat. No. 7,789,087 (Pham-September 2010).

A Primary Objective of the current invention was to solve this problem by creation of a structural configuration that when in operation, in an of itself, guarantees a consistent density of pack in a series of cigarettes created at a density chosen by the operator, and achieved without operation on an algorhythmic use of filling strokes or other such process, even when faced with different densities and moisture contents within the tobacco being used. No prior art structure has or can make such a claim.

B. Lack of Suggestion or Motivation to Modify Structures in the Referenced Prior Art And Differences in the Basic Principles of Operation of the Current Invention and Prior Art Structures None of the prior art alone or in combination provides a suggestion of any motivation to modify their structure in a manner that would lead to the development of a structural combination of a moveably-conjoined dual-plate injection/compression/compression-assessment assembly as is taught in the current invention, supporting non-obviousness under MPEP 2143.01.

1.(a) because one of the stated Objectives of the prior art referenced was their creation of a structure that provided a state of the art evenness of pack in cigarette tubes filled with their devices, and their assertions their devices fulfilled that objective, there was NO teaching, suggestion, or motivation in the prior art that would have led one of ordinary skill to modify their structure or to combine that structure with some teaching from other prior art in order to arrive at the level of pack control achieved by the instant invention; (b) Consideration 'of the whole' of the structures of the prior art referenced in light of consideration of the current invention as 'a whole' provides Objective Evidence the current invention avoids obviousness based on the Graham inquiry condition, (i) that the prior art referenced did not suggest the desirability and thus the obviousness of making any combination that might have reasonably been expected to lead to a comparable structural solution as provided by the current device; (ii) as a secondary support for the non-obviousness of the current invention, Objective Evidence in the form of the "failure of others" indicates the non-obviousness of the current invention.

2(a) Incorporation of the dual-plate assembly mechanism of the current invention into the prior art referenced would require Extensive Reconstruction and Redesign of the elements shown in the primary art referenced; (b) as well, it would require a change in the basic structural principle under which the primary prior art referenced was designed to operate.

It will be recognized by one skilled in the art that the device described below as a preferred embodiment is not a sole embodiment of the device. And, based on a user's personal choice, or on the needs in particular circumstances, with appropriate modifications, had the basic structure allowed such without extensive modification, any non-automated, hand cranked or semi-automatic, or a motorized embodiment, or even a fully automated embodiment, would benefit from and could operate more effectively by the use of a dual-plate assembly; as such assembly is described and taught as the primary novel and unanticipated structure in the current invention.

One skilled in the art will also recognize and appreciate, with the benefit of the discussion of the upper and lower plates of said dual-plate assembly as such is described in the present preferred embodiment of the device, that the term "plate" as used in the disclosure and claims for these components does not necessarily indicate a planar, flat, or rectilinear component.

Further, though the preferred embodiment taught involves a device for the loading of one cigarette tube at a time, multiple tube filling devices such as are taught in various U.S. patents could also be modified for adaptation of use with any device including the dual-plate assembly of the current invention.

Although, as stated above, variations from fully manual to completely automated are achievable and benefit from the invention of this application, the preferred embodiment described will be of the semi-automated variety, and will include motors rather than cranks, springs or levers as the primary motive forces and/or operational control elements involved in the operation of the device.

OBJECTS OF THE INVENTION

Accordingly, it is an object of this invention to provide an operationally manual, semi automatic or fully automatic structural apparatus as a device for a packing of a single cigarette or a series of cigarette tubes with a metered, precise amount of a loose tobacco that leads to a consistent filling of the tube with an optimal quantity of and to an even and complete density of tobacco; such that a burning rate and continuity of pack of the cigarettes are consistently the same, regardless of a cut of or a moisture content of the tobacco being used.

It is another object of this invention to provide a device that is simple to use and to clean.

It is another object of this invention to provide a device that is both affordable to an average income individual, and to provide a quality product that works consistently and with minimal operational problems.

DETAILED DESCRIPTION OF A PREFERRED EMBODIMENT

A major feature of the device is a moveably-conjoined dual-plate injection/compression/compression-assessment assembly ("dual-plate assembly") which will be described in great detail later.

Figure 3:
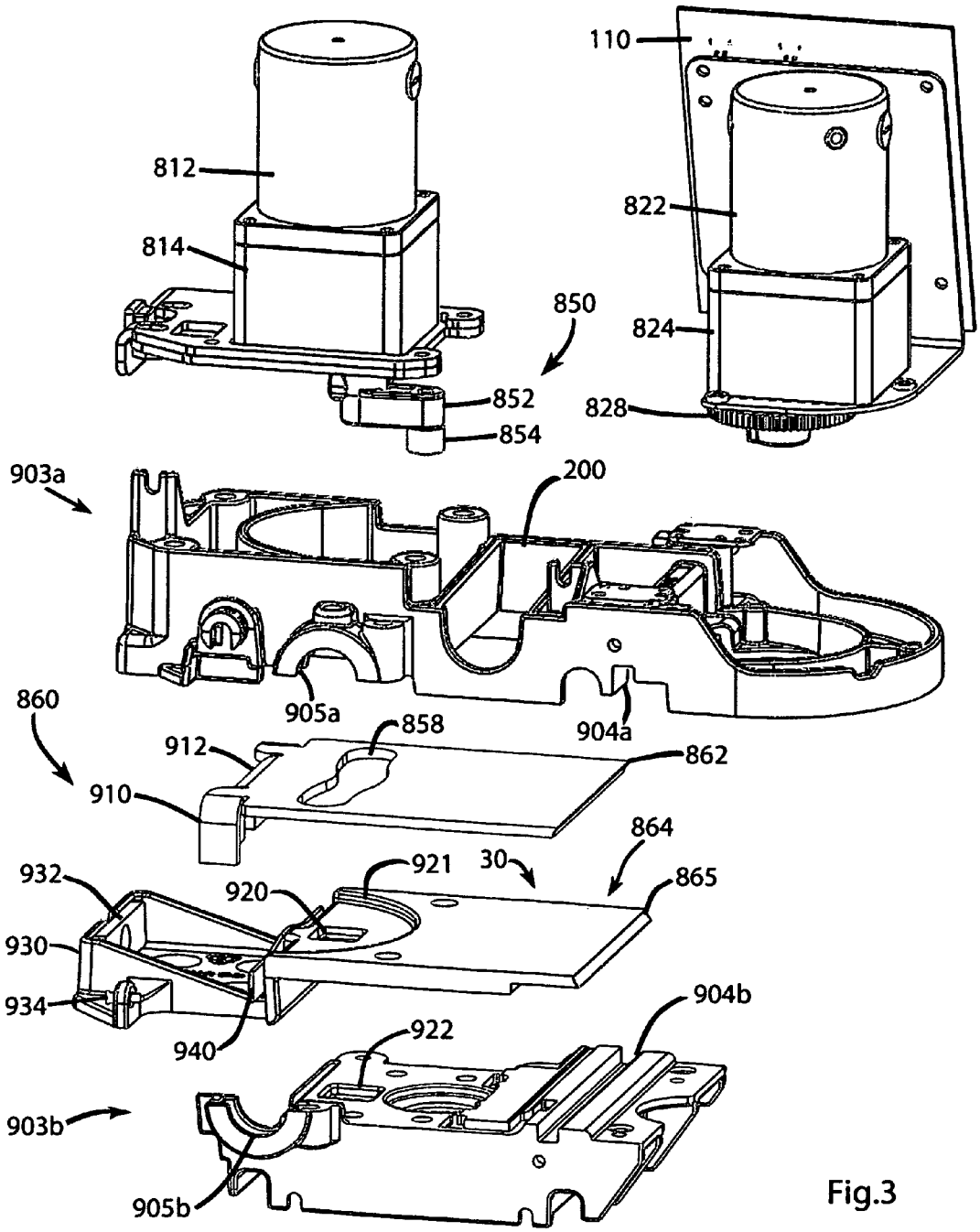
FIG. 3 Presents an exploded view of the basic components of the device as seen from the same vantage point as in FIG. 1 but with the outer shell removed.

As best seen in FIG. 3, two motive sources are involved in this embodiment, in this instance, two motors, a first motor, also known as a metering/compression section motor 812, and a second motor, also known as an injection section motor 822; an electronic, circuit control board 110 provides an automated control of a starting and stopping of said motors 812 and 822;

said automated control further involving a relaying of signals from a set of four switches, a photo interrupter switch 990 FIG. 4 (hereinafter referred to as "S1"), a fine tuning section limit switch 992 FIG. 6 (hereinafter referred to as "S2"), a photo interrupter switch 964 FIG. 5 (hereinafter referred to as "S3"), and, a photo interrupter switch 965 FIG. 5 (hereinafter referred to as "S4"), Referring to FIG. 1 an external view of a preferred embodiment 900 of a semi-automated device for filling a cigarette tube with a metered amount of a quantity of loose tobacco is illustrated. Said device 900 comprises in part an external housing 802 having a removable front panel 202, a quantity adjustment component control knob 980 of a quantity adjustment component 870 (best seen in FIG. 6); a forward end of a cigarette tube nipple 400 (FIG. 5), and again in FIG. 1, a forward end of an injection member 830, a switch membrane component 806 and a tube clamping unit 180 are seen.

Figure 5:
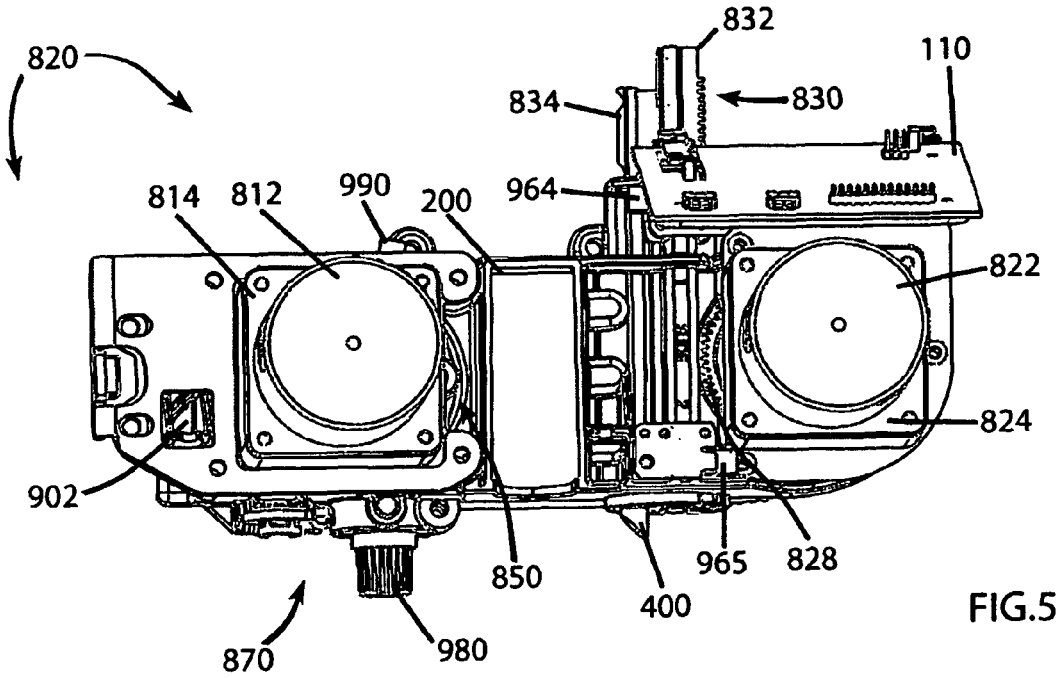
FIG. 5 Presents a top view of metering/compression section and the injection section of the device.

Referring now to FIG. 5 the device further comprises a hopper section 200 (only a base of which is portrayed), a metering/compression section 810, and an injector section 820; injector section 820 comprises in general, an injection section: motor 822, a gear box 824, and a gear 828, as well as an injection assembly 830.

As best seen in FIG. 5 the injection assembly 830 comprises in part a rack component 832 and a spoon mechanism 834. Under a motive power from motor 822, gear 828 engages the rack 832 of the injection assembly 830, providing thus for a forward carriage of a compressed tobacco rod (not shown) into a waiting cigarette tube (not shown) as well as subsequently providing a motive power for a full retraction of the injection assembly 830 to its starting position.

Figure 2:
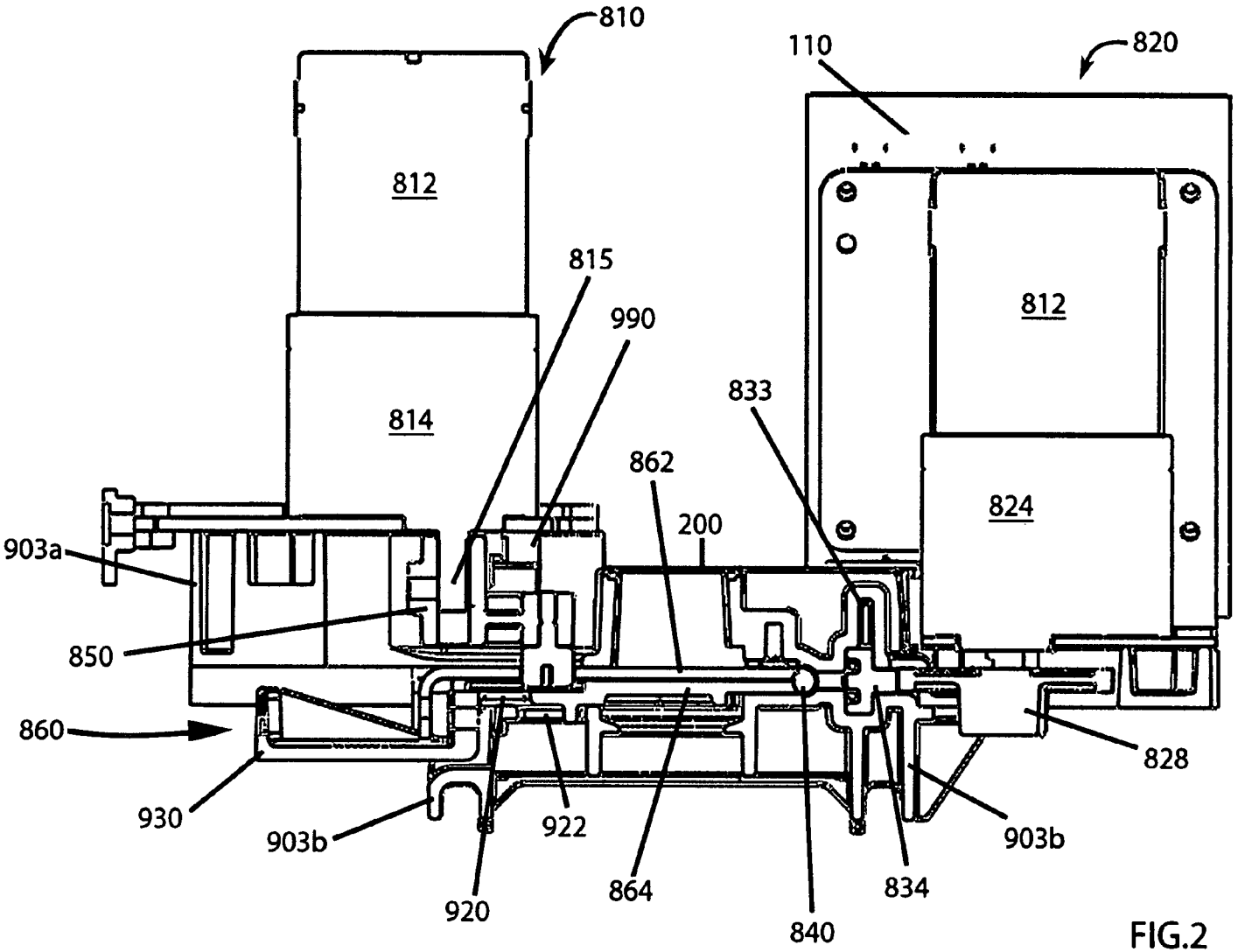
FIG. 2 Presents a transverse plane view showing the main features of the device.

As seen in FIG. 2, the injection/compression section 810 comprises in general, an injection/compression section motor 812, a gear box 814, a scotch yoke section 850, the dual-plate assembly 860 and an optical interrupter 990 (S1). The dual-plate assembly provides for an injection of as well as a metering of a quantity of loose tobacco from a hopper to a compression chamber of the device as well as for a compression of the tobacco within the compression chamber.

Figure 4:
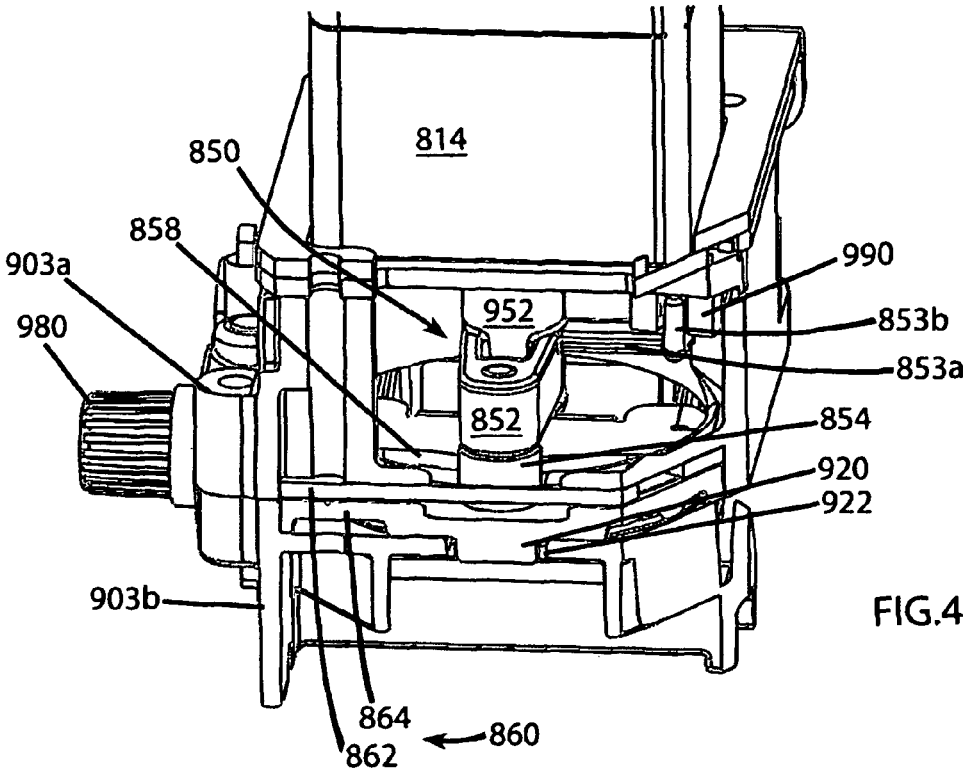
FIG. 4 Presents a sectional view showing the basic components of the scotch yoke assembly as it relates to a moveably-conjoined double plate metering/compression and compression-assessment assembly of the device.

As best seen in FIG. 4 Scotch yoke section 850 that is in affixation superiorly with a drive shaft 815 of gear box 814 comprises in part an upper yoke-body member 952 and an intermediate yoke-body section 852;

switching now to FIG. 3, an eccentrically located pin 854 inferiorly projecting from intermediate yoke body section 852, which is located in an off-axis position to gear box 814, passes through a slot 858 in an upper plate 862 of the dual-plate assembly 860, which said passage of said pin 854 through upper plate slot 858, provides a slideably moveable connection of the upper plate to the motor of the injection/compression section motor, thereby allowing of a motive force for an alternating tobacco compression forward stroke followed by a returning, tobacco reloading stroke of said upper plate when the injection/compression section motor 812 is in an actively operating mode and acting as a driving force of the double plate injection/compression/compression-assessment assembly of the device; the scotch yoke pin 854 comes to a termination within a hemispherical slot 921 in a lower plate 864 of the dual-plate assembly, but is not in an active contact with said lower plate;

lower plate 864 of metering/compression assembly 860 is not in a direct attachment to top plate 862 and is in a position sandwiched between top plate 862 and a horizontal structural surface of a lower block portion 903*b* (See FIG. 3) of the device; an upper block portion 903*a* is seen to form an upper housing bordering a top surface of said upper plate of the dual-plate assembly; forming thus a cavity within which is made an allowance for said lower plate to engage in a conjoint movement with said upper plate.

Again referring to FIG. 3, a plurality of tabs 910 and 912 on a rear termination of the upper plate 862 extend downward from plate 862. A pair of outer tabs 910 at the side edges of plate 862 is in a position of contact with a leaf spring 940 of lower plate 864, which leaf spring is in an affixation to a rear end aspect of a forward section 30 of lower plate 864. The engagement of the outer tabs 910 and the ends of the leaf spring 940 provide that a forward motion of said upper plate generally provides a motive force that drives the lower plate 864 forward, in a forward compression direction towards a compression chamber 840 (Best seen in FIG. 2) of said device.

Again referring to FIG. 3, a central tab 912 of upper plate 862 is in a position such that it moves into an engagement with a termination end of the forward section 30 of lower plate 864 when the upper plate 862 is in a fully forward compression position. A limiter 920 on the lower plate 864 engages in a groove 922 of the lower block portion 903*b*, which limits forward and back movement of the lower plate 864 when reciprocated. The use of the tabs 910 and 912 can help overcome disadvantages associated with stacking of precision errors.

As seen in FIG. 3 a rear portion 930 of lower plate 864 is seen extending below and rearward from a forward portion 30 of the lower plate 864; rear portion 930 defines a slot 931 (FIG. 7) for holding a neoprene bumper 932 (FIG. 3) that engages the upper plate 862 when the upper plate 862 is moved to a fully retracted position. The rear portion 930 of the lower plate 862 also includes an adjustment screw 934, which is used to fine-tune the adjustment mechanism 870 (Best seen in FIG. 6).

Figure 6:
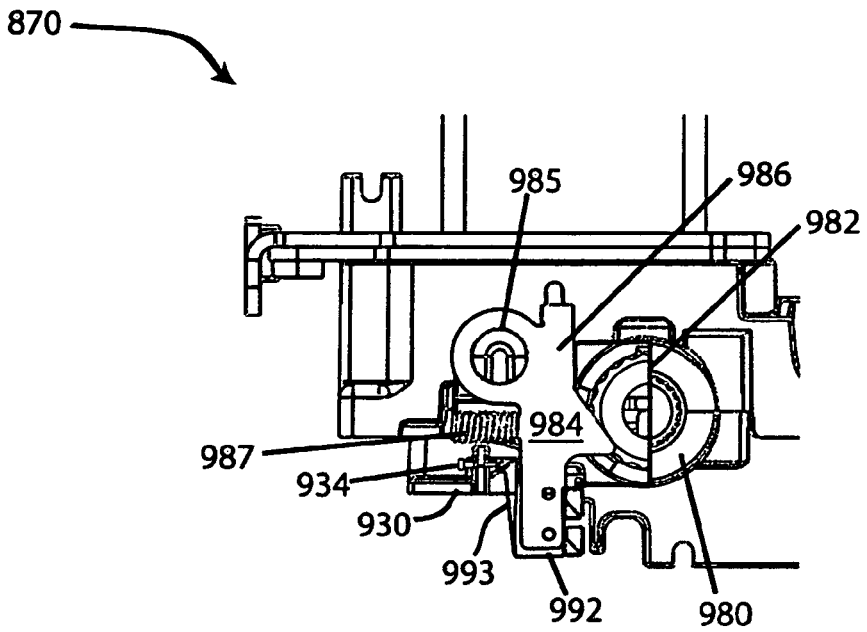
FIG. 6 Presents a sectional view of the quantity adjustment control assembly of the device.
Figure 7:
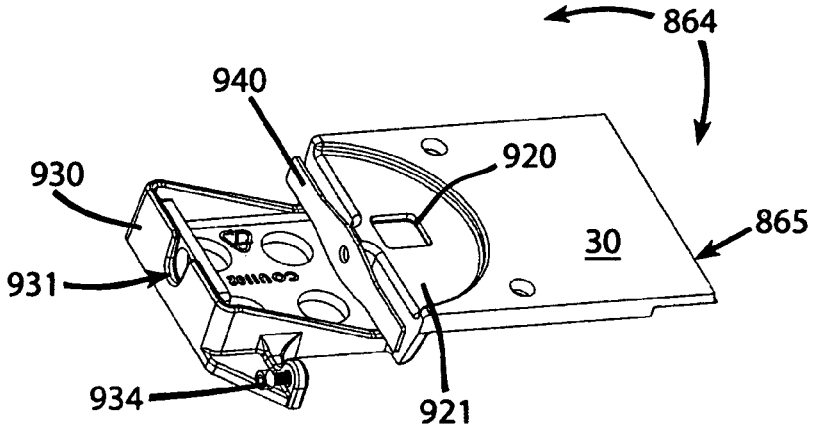
FIG. 7 Presents an exploded view of the undersurface of a lower plate injection/compression/compression-assessment member of a dual-plate injection assembly of the device.

As best shown in the detail view of FIG. 6 the adjustment mechanism 870 includes a knob 980, a linkage 984, and a limit switch 992. The adjustment knob 980 is positioned in slots defined in block sections 903*a* and 903*b*. (The slots are shown in the exploded view of FIGS. 3 at 905*a* and 905*b*).

Again referring to FIG. 6, the linkage 984 has one end pivotally attached to a pivot point 985 on upper block section 903*a*; a limit switch 992 is attached to the other end of the linkage 984 and pivots about the pivot point 985. The adjustment knob 980 has an eccentric surface 982 that engages a cam surface 986 of the linkage 984 and thereby adjusts the pivot location of the limit switch 992. A spring 987 biases the linkage 984 and pushes the cam surface 986 against the eccentric surface 982 of the knob 980.

Fine tuning limit switch 992 (S2) has a contact 993 that is capable of being engaged by a contact surface of the adjustment screw 934, which adjustment screw is in an attachment to the rear portion 930 of the lower plate 864. By adjusting the pivoted location of the limit switch 992 (S2), a point at which limit switch 992 (S2) detects or does not detect engagement with the adjustment nut of lower plate 864 can be adjusted. The adjustment screw 934 allows for a fine-tuning of the engagement point.

If adjustment screw 934 is in a contact with the limit switch 992 (S2), it signifies that an insufficient quantity of tobacco has been metered and compressed by the dual-plate assembly 860, and the injection-compression stroke process repeats itself.

At the end of each forward stroke of dual-plate assembly 860 (FIG. 2), as will be seen in FIG. 4, the photo interrupter 990 (S1) is interrupted by a flag 853*b* on an arm 853*a* of an intermediate member 852 of the scotch yoke 850; at this point, upper plate 862 is in a fully forward position.

Figure 1:
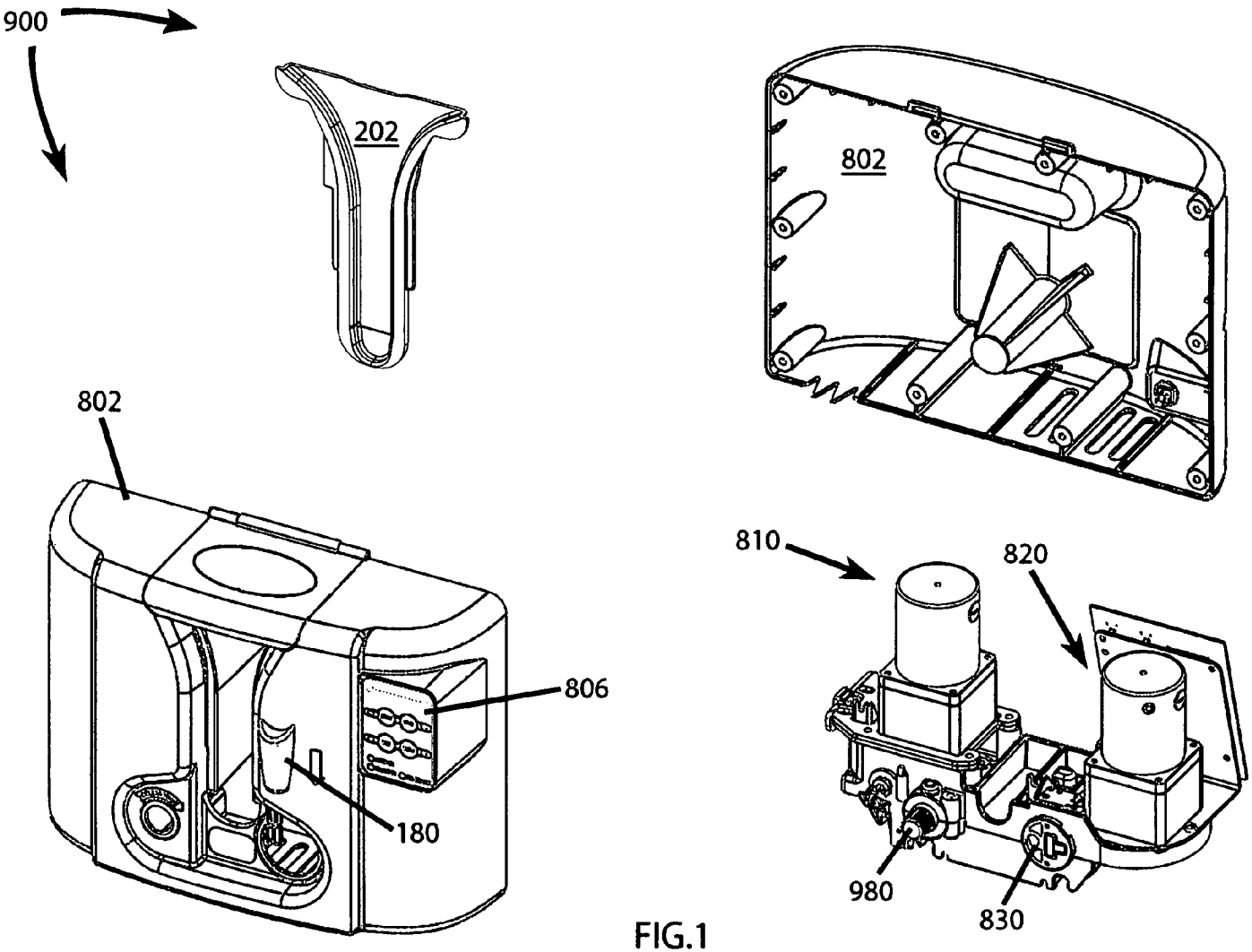
FIG. 1 Presents an exploded view of the exterior shell of the Device as seen from a fronto-superior vantage point at the right side of the Device; the basic internal components of the device are seen separated from the exterior shell.

Now referencing FIG. 6, if the limit switch 992 (S2) on fine tuning mechanism 870 is not engaged by the screw 934 on the lower plate 864 because the compressed rod of tobacco has forced lower plate 864 rearward enough to create a disengagement between the contact point of screw 934 and limit switch 992 (S2), the amount of tobacco metered and compressed will be deemed sufficient by interrupter 890 (S1) and an electronic circuit control board 110 FIG. 2 will provide a direction that metering section motor 812 ceases activity and that a LOAD light indicator is brought into an activation on control panel switch membrane 806 FIG. 1.

As can be seen from FIG. 2, in conjunction with (i) a motive force applied by the actions of the metering motor 812, (ii) the scotch yoke assembly 850 (iii) and the leaf spring 940, a situation of the dual-plate assembly 860 within a confine of a cavity defined superiorly by upper block section 903*a* and inferiorly by lower block section 903*b* creates an allowance for the lower plate 864 to move conjointly with upper plate 862, while also making an allowance for the lower plate 864 to move separately relative to the upper plate 862 when an optimal density of a tobacco rod in a compression chamber 840 creates a rear-ward pressure sufficient to overcome a bias of leaf spring 940 and thereby makes an allowance for, and, a separate rearward movement of lower plate 864 away from the compression chamber 840.

As best seen in FIG. 2, a compression chamber 840 of the device, within which a compression of loose tobacco occurs, comprises in part a series of curvilinear arcs of a same radius including (i) a top section arc formed by a section of upper block 903*a*, (ii) an injection section side arc formed by an inner aspect of a spoon section 834 of injector assembly 830, (iii) an inferior pole section arc formed by a section of lower block 903*b*; (iv) an injection/compression section side lower arc formed by a smooth faced forward edge of lower plate 864; (v) and an injection/compression section side upper arc comprising a serrated, forward edge (410 FIG. 8) of upper plate 862; and which said series of sectional curvilinear arcs arranged in a conjunction as described above complete a definition of a cylindrical aperture of a diameter appropriate for a formation of a compressed tobacco roll for an injection of said compressed tobacco roll into a preformed cigarette tube.

Figure 8:
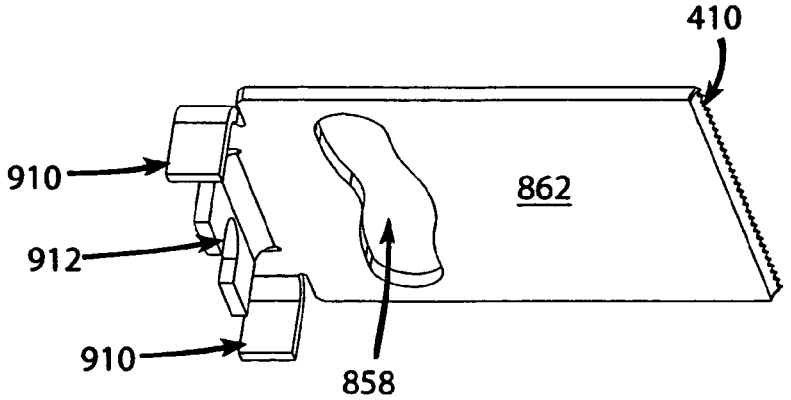
FIG. 8 presents an oblique view of the undersurface of an injection/compression member of a dual-plate assembly of the device.

Following a contacting of a START indicator in a switch membrane component 806 (FIG. 1), leads to an activation of metering motor 812 (FIG. 2) under a control of an electronic circuit control board 110; following which the dual-plate assembly travels to the right, carrying before it a measure of tobacco (not shown) from a hopper 200, which measure of tobacco proceeds rightward to roll forward over a leading edge 865 of the lower plate 864 (Best seen in FIG. 7) and into the compression chamber 840; the fully advancing upper plate 862 along with the biased lower plate 864 can gradually encourage the tobacco to rotate somewhat clockwise within the chamber 840 which helps ensure that a complete and cylindrical plug of tobacco is formed; ideally an arcuate upper edge 410 FIG. 8 of the upper plate further comprises in part a series of scallop shaped curved projections forming thus a serrated edge to better shear tobacco shreds prior to a return movement of said dual-plate assembly away from the compression chamber.

When a leading edge 410 of Upper plate 862 (Best seen in FIG. 8) has travelled a full range of a forward-compression stroke Scotch yoke flag 853*b* (FIG. 4) passes through photo interrupter 990 (S1) and S1 checks the status of limit switch 992 (S2)(FIG. 6);

IF a contact 993 (FIG. 6) of S2 is still in contact with a rear end of lower plate 864 (FIG. 2), metering motor 812 continues to run and another cycle of metering into the compression chamber follows; ultimately, a successive series of said compression strokes of said dual-plate assembly, in an incremental manner leads to a rearward movement of said lower plate and as the quantity of tobacco in the chamber 840 becomes of a density creating a pressure on a leading edge 865 of the lower plate 864 (FIG. 3) sufficient to overcome the bias of the lower plate leaf spring 940, a "final" metering stroke occurs; the final metering stroke initiating an activity of a cigarette roll compaction completion assessment-monitoring array of said device; which in turn initiates a switching from the injection/compression phase to the injection phase of the filling of a cigarette tube.

As a result, of an adequate recession of the lower plate 864, a contact point of an adjustment screw 934 is removed from a conjunction with a contact section 993 of limit switch 992 (S2), and fails to activate limit switch S2; also, during this "final" stroke, a passage of a flag 853*b* through a photo interrupter 990 (S1) signals a control board 110 to query S2 and, with S2 being in an inactive state after the final stroke, control board 110 determines that there is sufficient tobacco in the compression chamber 840 which provides a signaling of an end of a metering/compression action and a start of an injection action of said device.

At this point a signal from control board 110 lights up a LOAD section on external switch membrane 806; manually pressing that contact leads to an activation of injection section motor 822 (FIG. 5); after a full forward movement of injector assembly 830, including a full forward movement of spoon component 834 that leads to a carriage and a transfer of a compressed tobacco rod into a waiting empty cigarette tube (not shown) that is held in a removable affixation at a termination of the injector mechanism, interruption of a photo interrupter 965 (S4) initiates a return of injector assembly 830 to its rearward, rest position where a flag 833 (FIG. 2) which is in an affixation to a rack section 832 trips a photo interrupter switch 964 (S3)and injection section motor 822 stops;

after a release of the tube clamping unit 180 and removal of a packed cigarette from the nipple 400 and its replacement by an empty cigarette tube and reengagement of the tube clamping unit; pressing start on a switch membrane 806 leads to metering/compression motor 812 running and the metering, compression, injection cycle starts anew.

After an initial adjustment of the quantity control mechanism 870 for a creation of an optimal packing density of a cigarette using the device with a given cut of tobacco, cigarettes made at a later manufacturing session may be made using the same setting as was originally established; however, should a test cigarette made at the latter session, prove to have too easy or too hard a draw, the quantity control adjustment knob 980 can be used to incrementally increase or decrease the density of pack without an alteration of adjustment control screw 934 (FIG. 6).

CONCLUSION

One skilled in the art, appreciating the structure and method of application of the device of this invention will recognize that, if preferred: another embodiment might substitute manual levers, rotational control and/or spring activated motive structures for the electronic and electrical components taught in the preferred embodiment; and as well, that any electronic sensors used in the preferred embodiment in either limiting or initiating functions, could equally be replaced by mechanical means; and, needle gauges, battery operated lights and the like could be engaged with the appropriate initiating/limiting sensor to functionally replace any of the electronic control and/or display devices taught in the preferred embodiment; and that further, multiple tube filling capability could be afforded for any of the above potential embodiments according to existing devices for same that are known in the art.

Conversely; one knowledgeable in the art would appreciate that an embodiment as a fully automated device for filling a single or multiple tubes could advantageously be created by use of the dual-plate metering/compression-monitoring section of this invention.

The foregoing preferred embodiment teaches and demonstrates a partially automatic embodiment of a device for filling cigarette tubes with metered amounts of tobacco; one who is knowledgeable in the art will recognize that the dual-plate metering/compression-assessment assembly taught and described in this invention can be equally effective and consistently provide a chosen pack density of cigarette tubes in a cigarette tube filling device, be it fully manual to fully automatic and be it designed for filling a single tube at a time or for automatically filling multiple successive tubes; even though specific features, details, and configurations of such alternate embodiments were not specifically detailed in conjunction with the above presented preferred embodiment; it is specifically intended that such features, details, and configurations are covered by this patent to the extent that they come within the scope of the following claims or the equivalents thereof.

The invention claimed is:

1. A device for filling a cigarette tube with an optimal quantity of a loose tobacco, said device partially comprising a moveably-conjoined dual-plate injection/compression/compression-assessment assembly, which said dual-plate assembly provides for an injection of as well as a metering of a quantity of loose tobacco from a hopper to a compression chamber of said device, as well as for a compression of said loose tobacco within said compression chamber, said moveably-conjoined dual-plate injection/compression/compression-assessment assembly component comprising in part an upper plate injection/compression member as well as a lower plate injection/compression/compression-assessment assembly member;

said upper plate being in a slideably movable connection with an element of a motive mechanism, which element passes through a slot in said upper plate, and, with a movement of said element within said slot, creating a provision for an alternating tobacco-compression forward stroke and a returning stroke of said upper plate as said motive mechanism element acts as a driving force of said double plate injection/compression/compression-assessment assembly;

said upper plate further comprising in part a plurality of tabs on a rear end of said plate, a pair of which tabs, are in a contact position with a leaf spring of said lower plate; which said leaf spring is in an affixation at a rear end of said lower plate; said contact between said tabs and said leaf spring being of a nature such that a forward movement of said upper plate generally results in a simultaneous forward movement of said lower plate in said forward compression-direction towards said compression chamber of said device;

when said upper plate is in a fully forward compression position, a central tab of said upper plate is brought into an engagement with a termination end of said lower plate;

said moveable conjoinment of said upper plate and said lower plate comprising a relationship wherein said lower plate is in a position sandwiched between said top plate and a horizontal structural surface of a lower block portion of said device, with an upper block portion forming an upper housing bordering a top surface of said upper plate of said dual-plate assembly; forming thus a cavity within which is made an allowance for said lower plate to engage in a conjoint movement with said upper plate; and, a totality of a relationship between (i) said upper plate tabs, (ii) said lower plate leaf spring, alternatively providing for an allowance for said lower plate to move either conjointly with or separately relative to said upper plate (iii) when an optimal density of a tobacco rod in said compression chamber of said device creates a rearward pressure sufficient to overcome a bias of said leaf spring of said lower plate, thereby making an allowance for and a separate movement of said lower plate in a rearward direction from said compression chamber;

said overcoming of said leaf sprig bias, following a successive series of said compression strokes of said dual-plate assembly, in an incremental manner leading to a rearward movement of said lower plate such that said rearward movement creates a separation between a pair of elements of a cigarette roll compaction completion assessment monitoring array of said device;

said separation of said elements providing a signaling of an end of a metering/compression action and readiness of a start of an injection action of said device;

said device further partially comprising means for a transfer of a rod of compressed tobacco from said compression chamber into a cigarette tube held in a removable affixation at a termination end of said injection means.

2. Said device of claim 1, wherein the injection/compression/compression-assessment assembly, and the injection assembly are in an orthogonal structural orientation within the X and Z planes respectively.

3. Said upper plate of dual-plate assembly component of claim 1 comprising in part an arcuate forward end, which arcuate forward end ends superiorly as a serrated upper edge.

* * * * *